US008313079B2

(12) United States Patent
Schwoerer

(10) Patent No.: US 8,313,079 B2
(45) Date of Patent: Nov. 20, 2012

(54) CEILING FORMWORK SYSTEM

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 918 days.

(21) Appl. No.: 11/988,062

(22) PCT Filed: Jul. 3, 2006

(86) PCT No.: PCT/EP2006/006461

§ 371 (c)(1),
(2), (4) Date: Mar. 17, 2009

(87) PCT Pub. No.: WO2007/003400

PCT Pub. Date: Jan. 11, 2007

(65) Prior Publication Data

US 2009/0294627 A1 Dec. 3, 2009

(30) Foreign Application Priority Data

Jul. 4, 2005 (DE) ..... 10 2005 031 152

(51) Int. Cl.
*E04G 11/00* (2006.01)
*E04G 17/00* (2006.01)

(52) U.S. Cl. ..... 249/18; 249/210

(58) Field of Classification Search ..... 249/18–20, 249/210; 108/153.1–158.13; 248/188, 188.1
See application file for complete search history.

(56) References Cited

U.S. PATENT DOCUMENTS

| | | | | |
|---|---|---|---|---|
| 5,614,122 | A * | 3/1997 | Schworer | 249/210 |
| 2004/0075042 | A1 * | 4/2004 | Arozena Bergaretxe | 249/210 |

FOREIGN PATENT DOCUMENTS

| | | | |
|---|---|---|---|
| DE | 42 11 200 | C2 | 10/1993 |
| DE | 196 16 876 | A1 | 11/1997 |
| DE | 196 36 091 | A1 | 3/1998 |
| DE | 197 20 728 | A1 | 11/1998 |
| EP | 0 130 425 | A2 | 1/1985 |
| EP | 1 314 835 | A1 | 5/2003 |
| EP | 1 384 837 | A1 | 1/2004 |
| GB | 2 266 114 | A | 10/1993 |

OTHER PUBLICATIONS

System Huennebeck, "Topec-Deckenschalung Topeclagersystem," pp. 1-10 (Jan. 1990) with an English translation of the lower part of p. 8 only, beginning with the subheading "Wichtig" ("Important" in English).

* cited by examiner

*Primary Examiner* — Darnell Jayne
*Assistant Examiner* — Timothy M Ayres
(74) *Attorney, Agent, or Firm* — Kilpatrick Townsend & Stockton LLP

(57) ABSTRACT

The invention relates to a ceiling formwork system comprising several formwork elements, the bottom face of which is provided with supports that can be coupled to heads of vertical props. At least some areas of the cross section of said supports are embodied in a C-shaped manner, with two legs extending from a basic section. One of the legs is designed as a supporting surface that is to rest on a head of a vertical prop while the head of a vertical prop is provided with fixing elements which engage into one respective recess of a supporting surface. Said recess is configured so as to selectively couple the support to the vertical prop in two directions that are offset relative to each other by 90° at the end of the supporting surface which faces away from the basic section.

24 Claims, 14 Drawing Sheets

CEILING FORMWORK SYSTEM

CROSS-REFERENCES TO RELATED APPLICATIONS

This application is a U.S. National Phase and claims the benefit of PCT Patent Application No. PCT/EP2006/006461, filed Jul. 3, 2006, which claims the priority of German Patent Application No. 10 2005 031 152.0, filed Jul. 4, 2005, the disclosures of which are incorporated herein by reference.

BACKGROUND OF THE INVENTION

The invention relates to a slab formwork system comprising a plurality of formwork elements which have beams at their lower side which can be coupled to heads of vertical supports, the cross-section of the beams being made in C shape at least regionally with two limbs extending away from a base section, with one of the limbs being designed as a support surface for placement on a head of a vertical support.

A slab formwork system of this type is known from document EP 0 130 425 A1. This system consists of formwork panels on whose lower sides C-shaped beams are arranged which can be hooked with a head of a vertical support on a substantially vertical alignment, whereupon the formwork panels can be pivoted into a horizontal position while maintaining the hook connection. To avoid a displacement of the beams in their longitudinal direction relative to the head of the vertical support, the base section of the C-shaped beam is provided with an opening into which a fixing element can engage which is fixedly connected to the head of the vertical support.

The fact is disadvantageous in the known slab formwork system that, on a coupling of two, three or four formwork panels with one vertical support, all the formwork panels must have the same orientation among one another so that it is not possible to arrange a plurality of formwork panels extending perpendicular to one another on one vertical support. This missing possibility causes in a disadvantageous manner an only limited adaptation capability of the slab formwork system to the respectively present spatial relationships.

SUMMARY OF THE INVENTION

An object of the present invention is to be seen in further developing a slab formwork system of the initially explained kind such that formwork elements, in particular grid elements or formwork panels, can be coupled to the head of a vertical support in different alignments.

This object is satisfied in that the head of a vertical support has fixing elements each engaging in a respective recess of a support surface, with the recess being provided for the selective coupling of the beam to the vertical support in two directions offset by 90° with respect to one another at the end of the support surface remote from the base section.

In view of the fact that the recess for the fixing of the beams in their longitudinal direction relative to the vertical support is not provided in the base section in accordance with the invention, but rather in the support surface, and there in the region remote from the base section, it becomes possible to arrange a plurality of fixing elements at the head of a vertical support such that a beam can be fastened to the head of the vertical support in two directions offset by 90° with respect to one another. The variability of a slab formwork system in accordance with the invention is hereby increased with respect to known slab formwork systems in a manner such that the slab formwork system can be adapted in a respective ideal manner to individual circumstances by the selection possibility present on the attachment of formwork elements to a head of a vertical support.

Whereas, in accordance with the invention, the one limb of the beam serves as a support surface for the interaction with a vertical support, the other limb of the beam can be made as a contact surface for a plurality of longitudinal beams of a grid element onto which ultimately plywood is then applied. Alternatively, the other limb can, however, also be made as a contact surface for a formwork panel with, in this case, unlike the use of a grid element, no further elements being located between the beam in accordance with the invention and the formwork panel.

The beams used in accordance with the invention are preferably made as open sectional elements. Alternatively, however, closed sections can also be used in which then the described recess is likewise to be provided in the region of the respective support surface which is brought into contact with the vertical supports.

It is preferred for the support surface of the beam to have two, three or more recesses in each of the two mutually remote end regions of the beam. This plurality of recesses then makes it possible to couple a beam at different positions distributed over its length with a vertical support such that again different installation situations can be taken into account.

It is of advantage in this connection for at least two recesses of the support surface and two fixing elements of the head of a vertical support to be mutually spaced apart such that a simultaneous engagement of each of the two fixing elements is made possible in one each of the two recesses. In this case, the beam can then either be installed at a vertical support via the named simultaneous engagement such that it terminates flush with its head, or an installation can be carried out such that the beam projects beyond the head of the vertical support at both sides. On provision of a corresponding number of pairs of recesses, the beam can project beyond the head of the vertical support over different lengths adapted to the respective circumstances. These different lengths can be set simply by the selection of a suitable pair of recesses.

Even on the provision of at least two recesses in the support surface in one or both end regions of the beam, it is possible to couple these only via one of the two recesses with a fixing element of the head of a vertical support. This coupling variant is in particular selected when two beams aligned with one another in the longitudinal direction should be fastened to a common head of a vertical support.

It is particularly preferred for the support surface to have at its end region remote from the base section an upwardly extending or angled lug, preferably extending parallel to the base section, which is provided with a cut-out, in particular of V shape, which is aligned with the recess provided in the support surface such that the cut-out and the recess merge into one another. In this case, the assembly of a formwork element at a vertical support is particularly simple since the correct positioning between the recess provided in the support surface and the fixing element of the respective head is facilitated by the named cut-out. Specifically, a beam provided with the lug can be positioned above a head of a vertical support such that the cut-out present in the lug is located directly above the respective fixing element of the head, whereupon a lowering of the beam onto the head can then take place in which the fixing element of the head is "threaded" into the cut-out of the lug. It is then achieved by a subsequent pivoting of the formwork element around a pivot axis extending parallel to the longitudinal axis of the beam that the fixing element is introduced via the cut-out provided in the lug into the recess of the support surface corresponding therewith in a compulsory manner. The guiding of the fixing element to the recess of the support surface is in particular promoted by the V shape of the cut-out in the lug, with the width of the V-shaped cut-out growing as the spacing from the corresponding recess in the support surface increases.

It is furthermore advantageous for the lug to have two, three or more cut-outs of that type in each of the two mutually remote end regions of a beam, the cut-outs being aligned in each case with corresponding recesses in the support surface. In this case, a corresponding cut-out can then be provided in the lug for each recess in the support surface so that the introduction of the fixing element into any desired recesses of the support surface is facilitated.

The lower side of the support surface preferably extends obliquely upwardly in its assembled position starting from the base section so that in particular the angle between the lower side of the support surface and the base section is smaller than 90° and preferably amounts to between 70° and 80°. It is achieved by this measure that the disassembly of a formwork element in accordance with the invention can be carried out without problem since a pivoting away of a formwork element around an axis extending parallel to the beam is not impeded by an upward movement of surface regions of the formwork element. This is in particular made clear on an observation of the FIGS. 7*a-c* explained below.

The vertical supports can in each case be provided with a support head which, in addition to a support plane extending perpendicular to the longitudinal extent of the respective vertical support, has fixing lugs angled therefrom for engagement in at least one recess of the support surface of a beam. These fixing lugs then represent the above-explained fixing elements of the support head in this case. The use of angled fixing lugs is advantageous in that an element can be used for the support head which is plate-shaped in the raw state and from which specific regions, preferably corner regions, can be bent upwardly as fixing lugs so that it is not necessary to apply separate fixing elements to the support head. Alternatively, however, it is also possible to make the support head as a cast part or a forged part or also to make it from plastic.

Four fixing lugs, for example, can be provided per support head which in particular extend perpendicular to the support plane of the support head. Adjacent fixing lugs of a support head can extend perpendicular to one another in this connection.

It is particularly preferred for the support plane to have a substantially square shape, with its fixing lugs each extending parallel to diagonals of the support plane. In this case, corner regions of the support plane square in its basic shape can then actually be bent upwardly at right angles in order thus to form the fixing lugs in accordance with the invention.

It is particularly advantageous for the support head to have abutment regions for the rear side of the base section of a beam remote from the limbs, with the abutment surfaces of the abutment regions in particular extending perpendicular to the support plane. With a beam coupled to such a support head, regions of the fixing elements or fixing lugs are located, at the end of an assembly procedure in the recesses of the support surface made complementary thereto, with simultaneously the rear side of the base section being supported at the abutment regions or coming to lie only at a small spacing from these abutment regions. These abutment regions thus prevent the fixing elements from being able to be moved out of the recesses so that a reliable and defined fixing of a beam to a support head is ensured here.

A total of eight abutment regions are preferably provided whose abutment surfaces in particular extend at an angle of 45° to the fixing lugs. These eight abutment regions make it possible for a respective beam to be able to be secured to the support head at four different positions, with two alignments of the beam offset by 90° with respect to one another being possible in a horizontal plane at each of these four positions. Overall, therefore, four different beams can be simultaneously arranged at a support head, with the alignment of each individual beam being able to be selected individually.

The named abutment regions of the support head can be formed by separate abutment elements which are subsequently coupled to the support head. It is, however, preferred for four abutment regions to be formed by a section of the support head, or of the plate-shaped element from which the support head is made, bent into a U-shape and extending upwardly from the support plane. Two further abutment regions each can be formed in each case by one abutment lug bent upwardly out of the support plane. In this manner, the use of separate elements can be completely avoided and it is furthermore possible to produce the total support head from one single plate-shaped element.

The support head used in accordance with the invention can be connected to the vertical support associated with it either releasably or also fixedly.

It is particularly advantageous for the support head to be able to be coupled with a preferably substantially square head plate of a commercial vertical support, with the sizes of the head plate and the support head being able to be approximately the same with respect to one another. In this connection, the support head can be able to be pushed onto the head plate in a direction extending parallel to the head plate of the vertical support. The lower side of a support plane of the support head preferably comes to lie directly on the head plate of the vertical support in the assembled position such that no elements are needed which extend the vertical support beyond their head plate. The spacing between the upper side of the head plate of the vertical support and the support plane of the support head therefore corresponds, in this advantageous embodiment, substantially to the thickness of the material used for the support head.

When a releasable connection is provided, the support head can—as already mentioned—be pushed onto a vertical support in a direction extending parallel to its support plane and can be fixed there, in particular by means of a spring member held in the support head. This spring member then represents the only element of the support head which cannot be made from one plate-shaped base element. When made from plastic, the spring member can also be made integrally with the support head.

It is preferred in accordance with the invention for all support heads, vertical supports and/or end regions of the beams used to be made the same with respect to one another. This then makes possible any desired combination variants and avoids the erroneous handling of individual components of the slab formwork system in accordance with the invention.

The assembly of a slab formwork system in accordance with the invention can be carried out particularly comfortably for a fitter when the vertical support and the beam of a formwork element can be hooked to one another in such a position in which the formwork element and the vertical support include an angle smaller than 90°. It is preferred in this connection for the formwork element to extend substantially parallel to the respective vertical support or to the respective vertical supports on the establishing of this hook connection.

After the hooking together, a pivoting of the formwork element can then take place while maintaining the hook connection into such a position in which the formwork element and the vertical supports include an angle of approximately 90° so that the formwork element extends in a horizontal plane in which it can ultimately be used for the production of a concrete ceiling.

The formwork elements used in accordance with the invention can, for example, consist in each case of longitudinal beams extending parallel to and spaced apart from one another which are fixedly connected to at least one cross beam extending perpendicular thereto, with the upper sides of the longitudinal beams forming a contact surface for plywood, the upper side of the cross beam or beams contacting the lower side of the longitudinal beams and the lower side of the cross beam or beams forming a support surface of the described type. In this case, the formwork elements in accordance with the invention therefore form grid elements which are first installed onto the vertical supports, whereupon the plywood or the formwork panels can be applied to the grid elements.

Alternatively, however, it is also possible to form the formwork elements such that plywood is applied directly to the beam explained above, in particular onto its upper sides. In this case, already completed formwork panels comprising plywood and beams are installed on the vertical supports in the manner in accordance with the invention.

The formwork elements preferably only have one or two beams or cross beams, which are in particular straight, with them extending parallel to one another when two beams or cross beams are provided. It is therefore not necessary in accordance with the invention to provide the formwork elements with a peripheral section at its lower side. Furthermore, no beams are also needed which extend parallel to the longitudinal beams mentioned.

BRIEF DESCRIPTION OF THE DRAWINGS

The invention will be described in the following with reference to embodiments and to the drawings.

DESCRIPTION OF THE PREFERRED EMBODIMENTS

Figure 1:
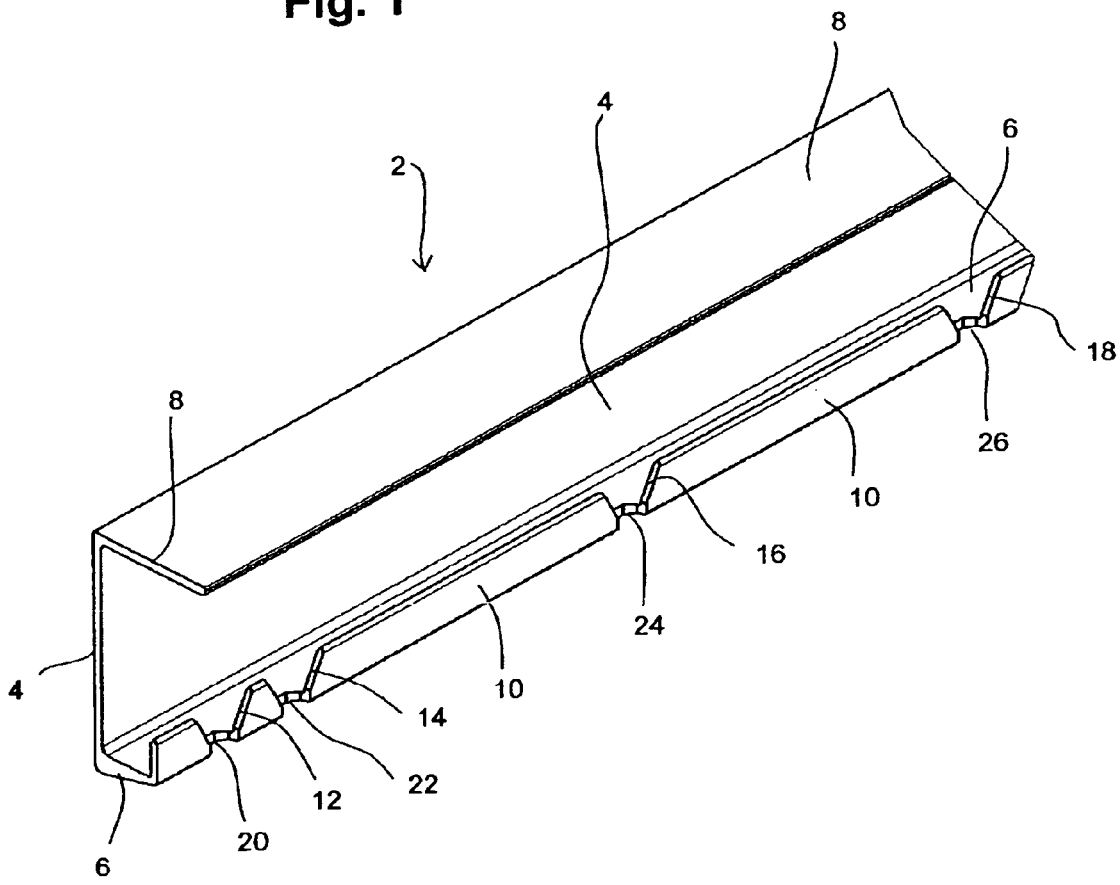
FIG. 1 is a three-dimensional view of an end section of a beam used within the framework of the invention and being able to be coupled to the head of a vertical support.

The beam 2 shown in FIG. 1 is made as an open elongate section element which has a C-shaped section with two limbs extending away from a base section 4, with the lower limb being designed as a support surface 6 for placement on a head of a vertical support. The upper limb forms a contact surface 8 for the lower sides of longitudinal beams which extend, for example, perpendicular to the beam 2, which in this case then forms a cross beam, so that the longitudinal beams together with the beam 2 and, optionally, further cross beams form a grid element onto which plywood can be attached. Alternatively, the contact surface 8 can also serve directly as a contact surface for plywood.

In the beam 2 shown, the base section 4—viewed in cross-section—is longer than the contact surface 8, which is in turn longer than the support surface 6. The length of the contact surface 8 amounts to approximately twice the length of the support surface 6, whereas the length of the base section 4 amounts to approximately twice the length of the contact surface 8.

The lower side of the support surface 6 does not extend parallel to the contact surface 8, but rather obliquely upwardly in the direction of the contact surface 8. It results in this manner that the thickness of the support surface 6 becomes smaller as the spacing from the base section 4 increases, since the upper side of the support surface 6 facing the contact surface 8 extends, unlike its lower side, parallel to the contact surface 8. The advantages of this design will be explained in the following in connection with FIGS. 7*a-c*.

An upwardly angled lug 10 is shaped on the end of the support surface 6 remote from the base section 4 and extends parallel to the base section 4 in the direction of the contact surface 8. Alternatively to the named angling, a round transition could also be formed between the support surface 6 and the lug 10 so that e.g. substantially the shape of a quarter-circle is adopted in the cross-section between the support surface 6 and the lug 10. The lug 10 in the embodiment shown is provided with four V-shaped cut-outs 12, 14, 16, 18 which are spaced apart from one another in the longitudinal direction of the beam 2, with the width of these cut-outs 12 to 18 each reducing as the spacing from the contact surface increases. The cut-outs 12 to 18 extend over the total height of the lug 10 and merge in their lower end region into recesses 20, 22, 24, 26 of the support surface 6. The width of the recesses 20 to 26 in this process corresponds approximately to the width of the V-shaped cut-outs 12 to 18 in their end region facing the recesses 20 to 26. The recesses 20 to 26 extend into the support surface 6 by less than half the length of the support surface 6.

Due to their V-shaped design, the cut-outs 12 to 18 can form a "threading aid" for the introduction of fixing elements into the recesses 20 to 26 by the named arrangement of the cut-outs 12 to 18 and of the recesses 20 to 26, with this threading aid in particular being effective when the beam 2 is pivoted upwardly by 90° into its position shown in FIG. 1 after the guiding up to a fixing element. This pivot movement is promoted by the explained oblique orientation of the lower side of the support surface 6.

Only an end region of the beam 2 is shown in FIG. 1. The other end region (not shown) of the beam 2 is made analogously to the end region shown so that the beam 2 has four respective cut-outs 12 to 18 and four recesses 20 to 26 in each of its two end regions. The cut-outs 12 and 14 in this process are provided in the outermost end region of the beam 2 only slightly spaced apart from one another, whereas the spacing between the cut-outs 14 and 16 and the spacing between the cut-outs 16 and 18 is dimensioned larger and in each case corresponds to the spacing of adjacent fixing elements of a head of a vertical support.

Figure 2:
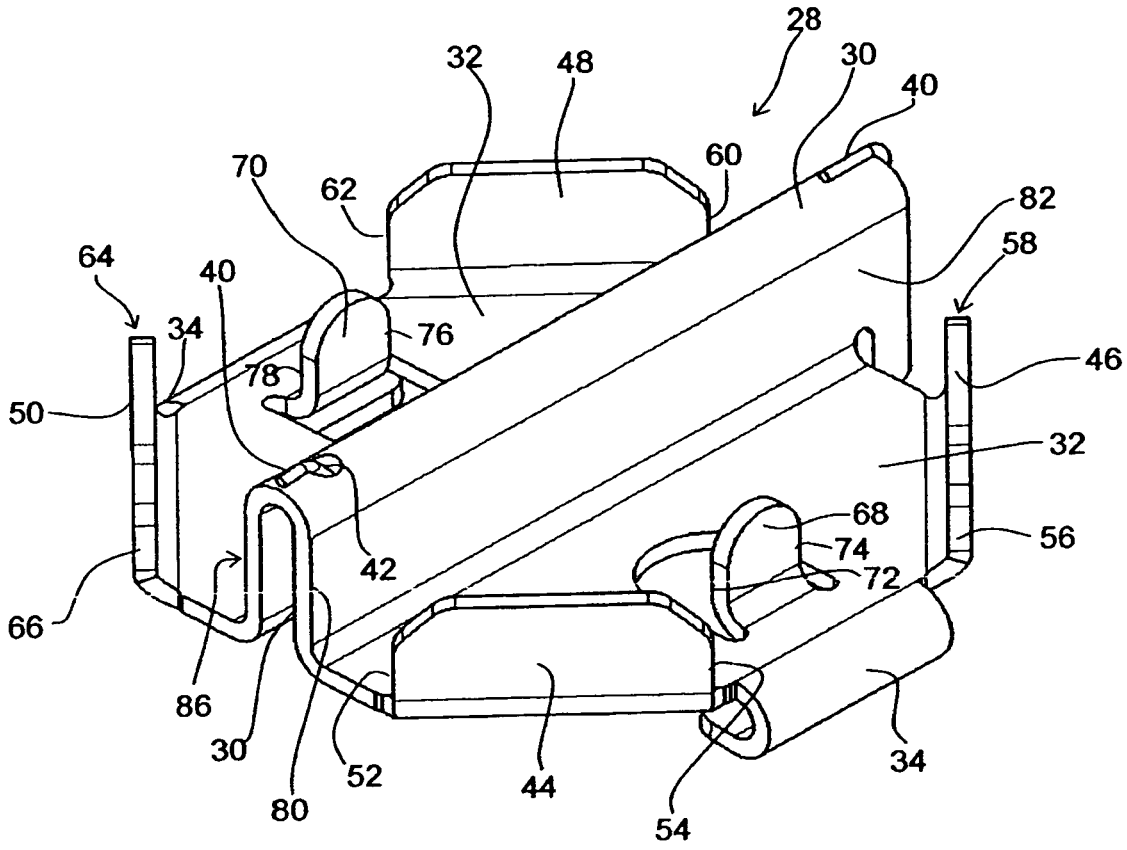
FIG. 2 is a three-dimensional view obliquely from above of a head of a vertical support which can be coupled to a beam in accordance with FIG. 1.
Figure 3:
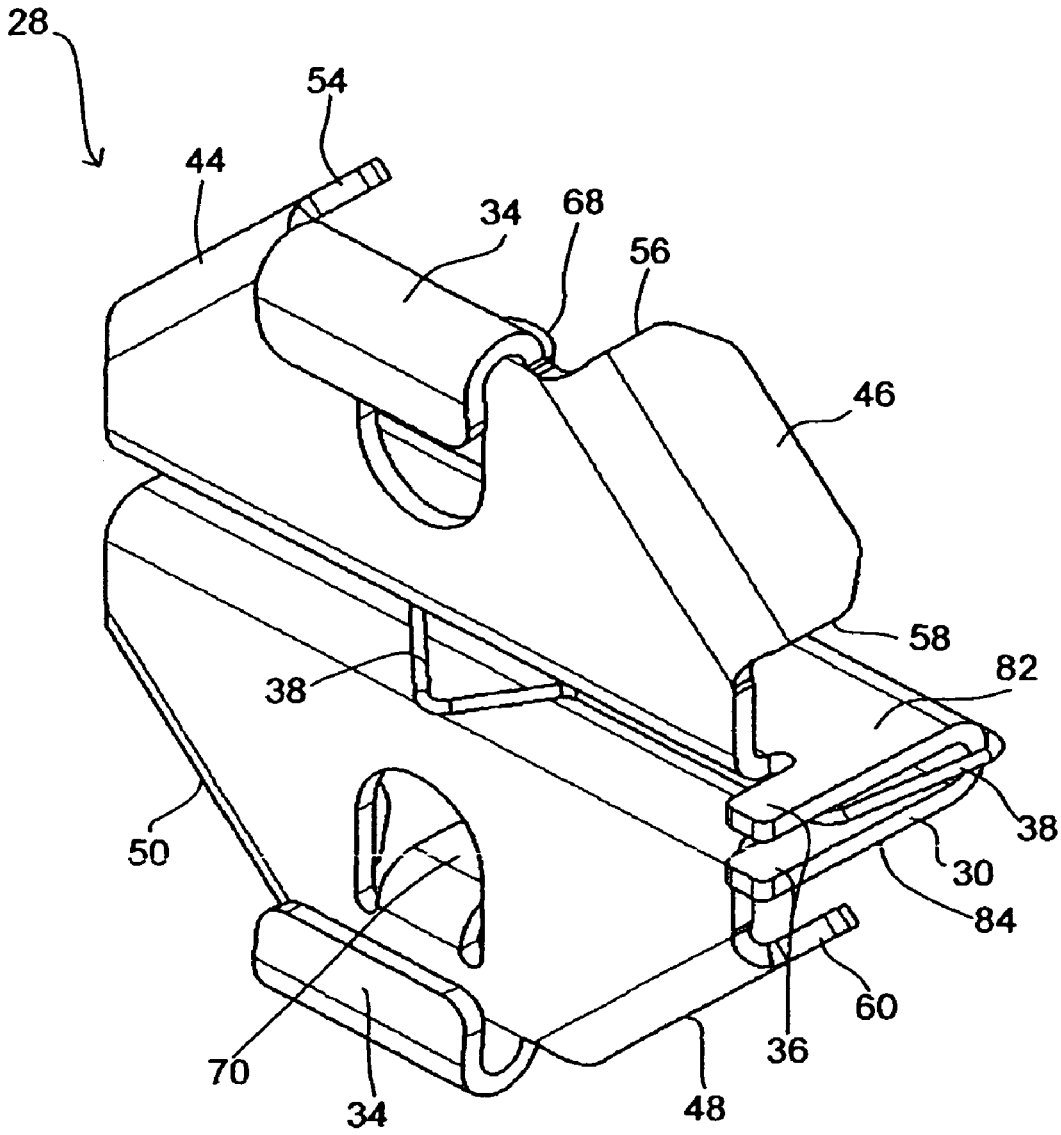
FIG. 3 is a view obliquely from below in accordance with FIG. 2.

FIGS. 2 and 3 each show in a three-dimensional view a head 28 which can be coupled to a vertical support (not shown). The head 28 in this process is produced from an originally substantially rectangular steel plate which is curved such that a U-shape curved section 30 is formed in its central region which extends upwardly over the total width of the head 28. The U-shaped section 30 in this process divides the base surface of the head 28 formed as a support plane 32 into two halves of equal size with respect to one another. With beams 2 installed at the head 28, the named support plane 32 absorbs the vertical forces to be transmitted from the beams 2 onto a vertical support since the support surface 6 of a beam 2 is ultimately supported on the support plane 32 of the head 28, which will be explained in the following.

Spaced apart perpendicularly from the U-shaped section 30, the support plane 32 has a respective coupling lug 34 which is curved downwardly in U shape at each of its two end regions remote from one another so that a receiving plane for a head plate (not shown) of a vertical support is defined between the coupling lugs 34 facing one another which extends parallel to the support plane 32. A head plate of this type can be pushed in the longitudinal direction of the U-shaped section 30 into the coupling lugs 34 until it abuts two abutment members 36 which are made integrally with the U-shaped section and extend downwardly, starting from this, into the named receiving plane for the head plate of the vertical support.

Figure 4:
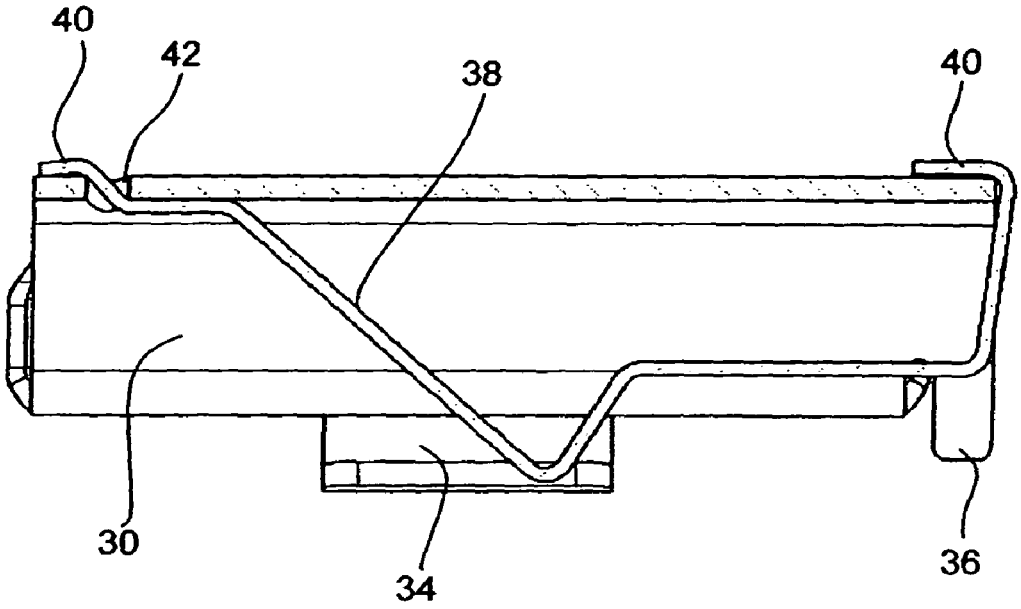
FIG. 4 is a section through a head of a vertical support in accordance with FIGS. 2 and 3.

A spring member 38, which can be seen from FIGS. 2 and 3, and in particular also from FIG. 4, is fastened in the hollow space surrounded by the U-shaped section 30. The end sections 40 of the spring member 38 are curved in the region of an opening 42 of the U-shaped section 30 and in the region of an end-face end of the U-shaped section 30 such that the spring member 38 is captively held at the head 28. The spring member 38 is shaped in this process such that a middle section of the same extends downwardly at least up to and into the receiving plane provided for the head plate of a vertical support and formed between the coupling lugs 34 such that the named section of the spring member 38 can snap into an end-face hollow space of a vertical support or of a head plate of a vertical support, whereby the head 28 can be fixed in a defined position with respect to a vertical support. In such a position, the two abutment elements 36 abut an edge of the head plate of a vertical support. When the head 28 is pulled from a vertical support, the spring member 38 is deformed by the removal force such that the spring member 38 ensures a correct positioning of the head 28 relative to the vertical support, on the one hand, but also permits a subsequent release of the head 28 from a vertical support, on the other hand.

The four corner regions of the support plane 32 are each bent upwardly perpendicular to the support plane 32 so that they form a total of four fixing lugs 44, 46, 48, 50 which each extend at an angle of 45° to the longitudinal direction of the U-shaped section 30. The width of the fixing lugs 44 to 50 amounts to somewhat more than twice their height, with the two corner regions of the fixing lugs 44 to 50 remote from the support plane 32 in each case being chamfered. Each of the two perpendicular edges 52, 54; 56, 58; 60, 62; 64, 66 of the fixing lugs 44 to 50 in this process forms a respective fixing element which is suitable in the sense of the invention for an engagement into a recess 20 to 26 of a beam 2. On a coupling of a beam 2 via one of the fixing lugs 44 to 50, in each case always only one of the two fixing elements 52 to 66 of a fixing lug 44 to 50 becomes effective. The provision of two fixing elements 52 to 66 per fixing lug 44 to 50 makes it possible to couple a beam 2 to a fixing lug 44 to 50 selectively in two directions offset to one another by 90° and extending parallel to the support plane 32.

A respective abutment lug 68, 70 is bent upwardly out of each of the two halves of the support plane 32, with each of the two end-face edges of the abutment lugs 68, 70 extending perpendicular to the support plane 32 respectively forming an abutment surface 72, 74, 76, 78 for the rear side of the base section 4 of a beam 2.

Four further abutment surfaces 80, 82, 84, 86 are formed by regions of the U-shaped section 30 extending perpendicular to the support plane 32. These abutment surfaces 80 to 86 are also each suitable to cooperate with the rear side of the base section 4 of a beam 2.

Specifically, a beam 2 can be fixed between the following pairs of mutually respectively oppositely disposed fixing elements 52 to 66 and abutment surfaces 72 to 86:

52, 80; 54, 72; 56, 74; 58, 82; 60, 84; 62, 76; 64, 78; 66, 86.

Figure 5:
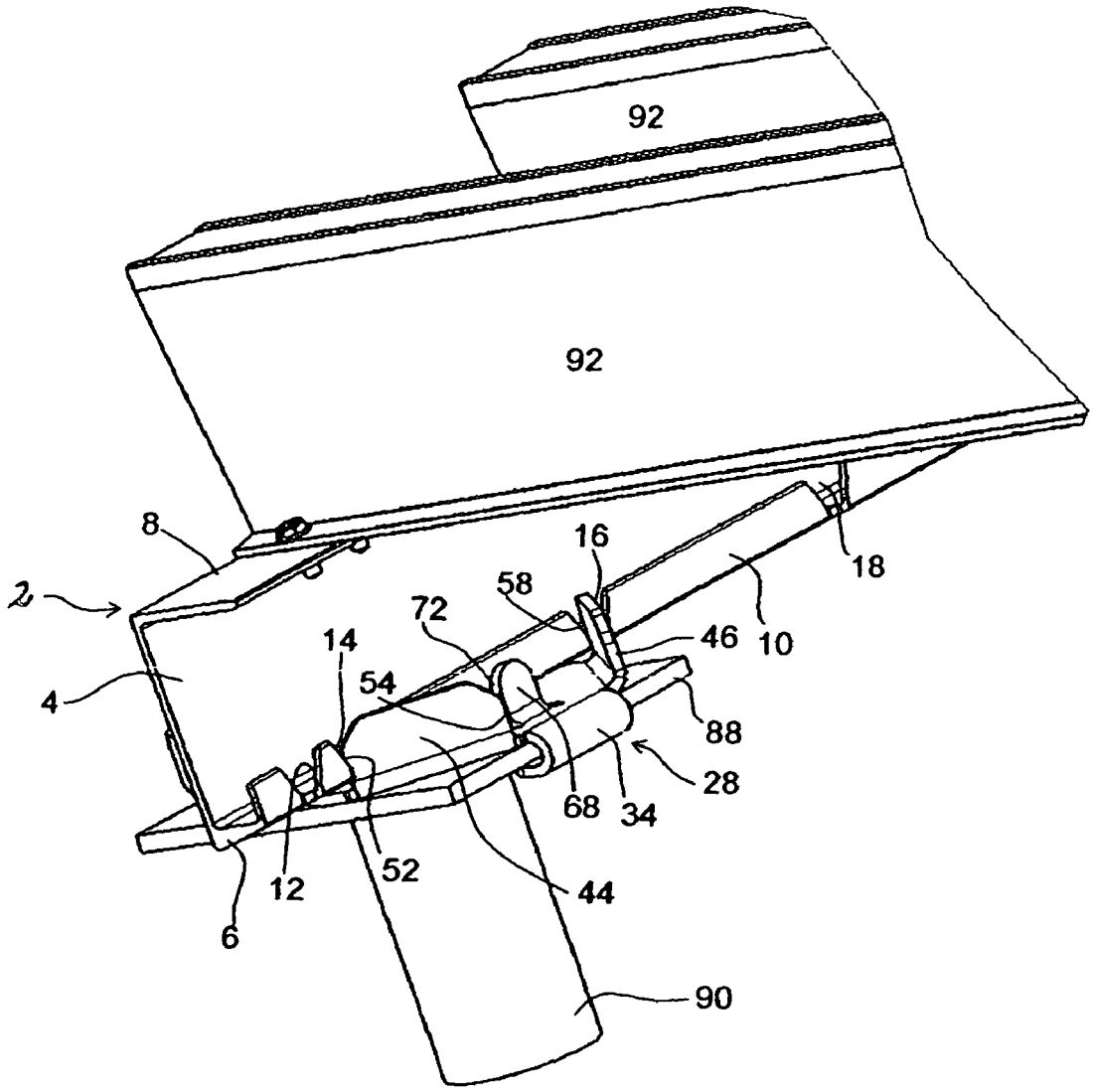
FIG. 5 is a three-dimensional view obliquely from above of a beam in accordance with FIG. 1 coupled to a head of a vertical support in accordance with FIGS. 2 to 4 in a first fastening position.
Figure 6:
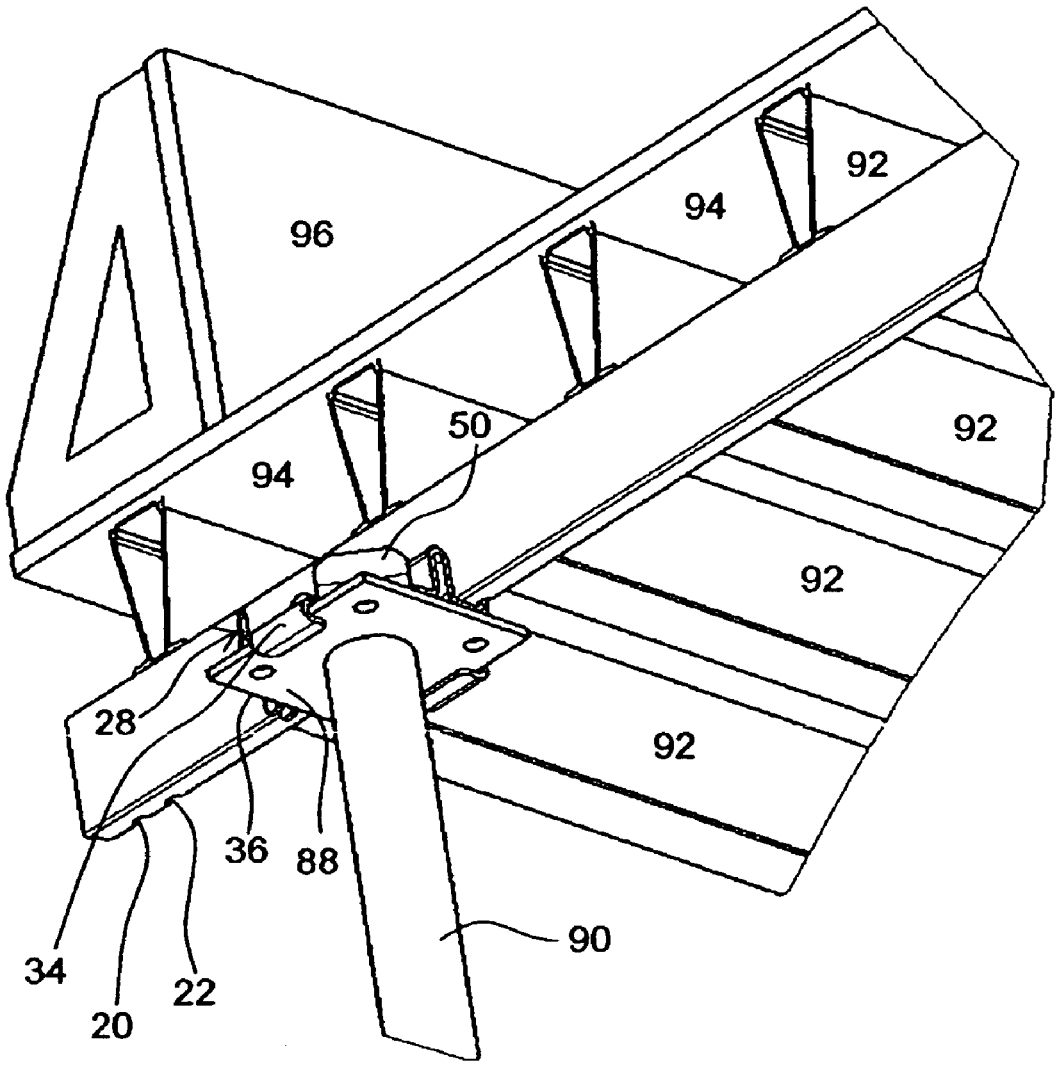
FIG. 6 is a view in accordance with FIG. 5 obliquely from below with the realization of a second fastening position.

FIGS. 5 and 6 show a head plate 88 of a vertical support 90 which is pushed so far into coupling lugs 34 of a head 28 until an edge of the head plate 88 abuts the abutment elements 36 of the head 28. A respective beam 2 in accordance with FIG. 1 is coupled to the head 28 and longitudinal beams 92 are fastened to its contact surface 8 and extend perpendicular to the beam 2. In accordance with FIG. 6, plywood 94 is secured at the upper side of the longitudinal beams 92 and is in turn coupled to a bulk formwork 96.

In accordance with FIG. 5, the beam 2 is coupled to the head 28 such that the fixing element 52 extends into the cut-out 14 and into the recess 22. At the same time, the fixing element 58 extends into the cut-out 16 and into the recess 24. The base section 4 of the beam 2 in this process is supported at its rear side at the abutment surfaces 80 and 82 so that ultimately these abutment surfaces 80, 82 effectively prevent—together with the fixing elements 52, 58—the beam 2 from being able to move perpendicular to its base section 4. The engagement between the fixing elements 52, 58 and the recesses 22, 24 simultaneously ensures that no movement can take place relative to the head 28 in the longitudinal direction of the beam 2.

Alternatively, the beam 2 could also be coupled to the head 28 in a position which is offset in the longitudinal direction of the beam 2 and in which the fixing elements 52, 58 would engage into the cut-outs 16, 18 or into the recesses 24, 26 corresponding therewith. Such a coupling is shown in FIG. 6 from which it can easily be seen that the recesses 20, 22 of the beam 2 remain unused here and the beam 2 projects further beyond the head 28 than in the position in accordance with FIG. 5.

It would furthermore also be possible only to couple the beam 2 with the head 28 in that the fixing element 58 is introduced into one of the two cut-outs 12, 14 and the recesses 20, 22 corresponding therewith. In these cases, the beam 2 would then no longer extend over the whole support plane 32 of the head 28 as in accordance with FIGS. 5 and 6. It would rather only extend over less than half the width of the support plane 32 so that, for example, a further beam 2 could be coupled to the head 28 via the fixing element 52 so that both beams 2 would extend aligned with one another in the longitudinal direction.

Finally, a beam 2 could also be coupled to the head 28 via its cut-outs 12, 14 or recesses 20, 22 such that it extends perpendicular to its alignment shown in FIG. 5. In this case, the fixing element 54 would then engage into one of the recesses 20, 22, with the rear side of the base section 4 of the support being supported at the abutment surface 72 of the abutment lug 68.

It is in particular also possible to couple two, three or four beams 2 to the head 28, with each of the beams 2 then being able to be fixed between one of the pairs of fixing elements 52 to 66 and abutment surfaces 72 to 86 already named above. The individual beams 2 can extend parallel or also perpendicular to one another.

Figure 7A:
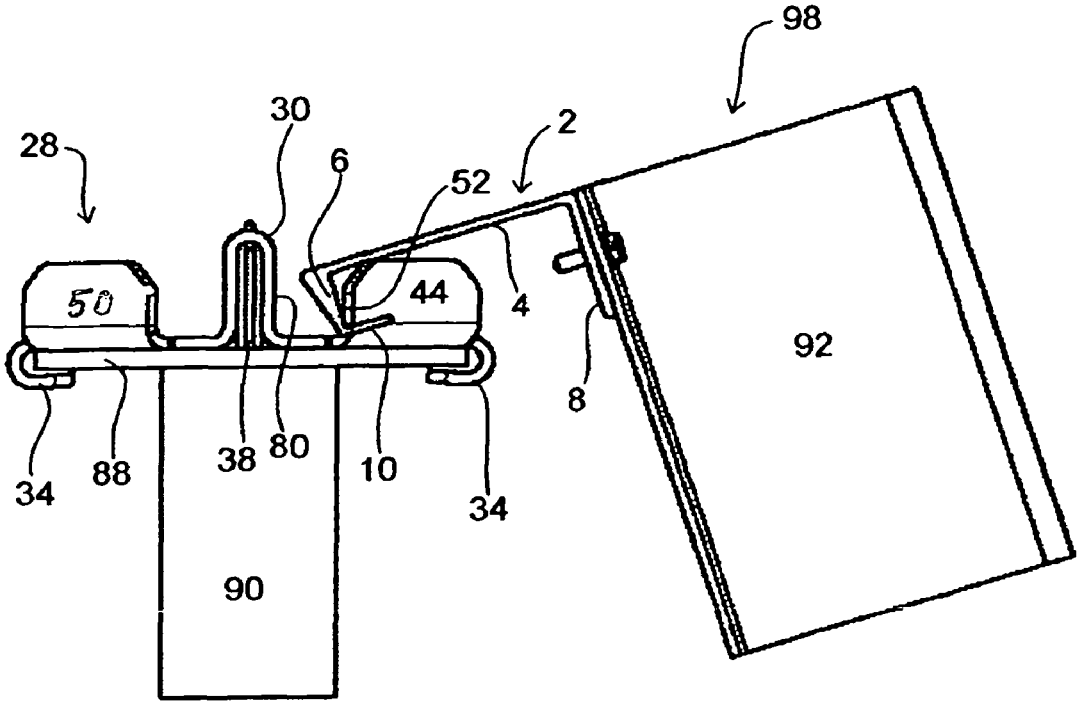
FIGS. 7*a-c* in each case are a side view of different methods steps on the coupling of a beam in accordance with FIG. 1 with a head in accordance with FIGS. 2 to 4.
Figure 7B:
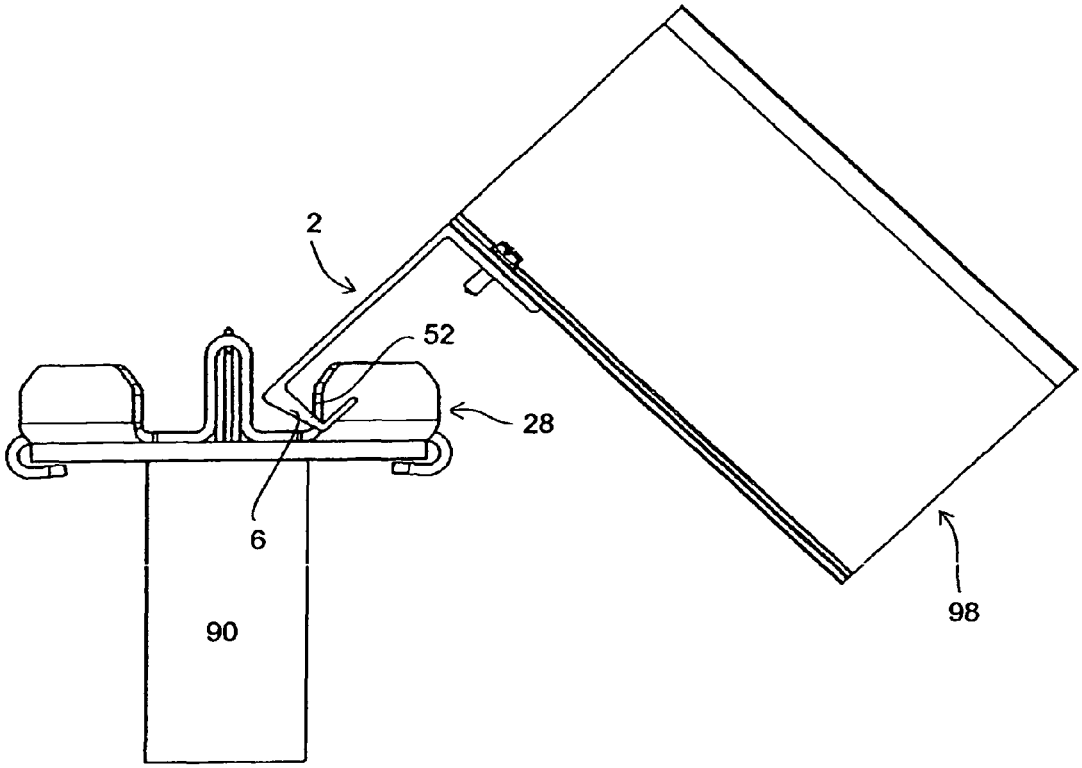
Figure 7C:
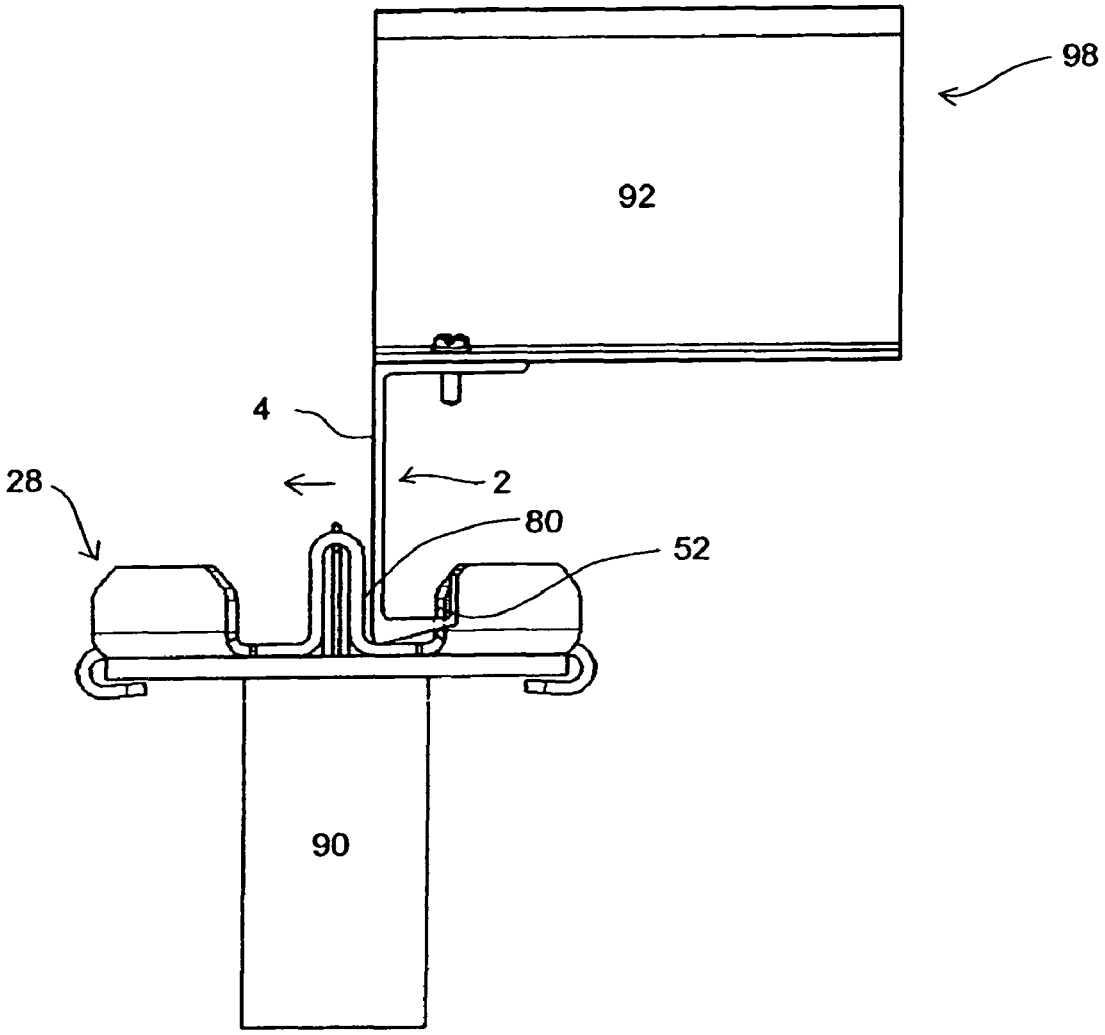

FIGS. 7*a-c* show how a coupling can be established between the beam 2 and the head 28 as is shown in FIG. 5.

First, a formwork element 98 consisting of beams 2 and longitudinal beams 92 is aligned relative to a vertical support 90 such that the longitudinal beams 92 extend either substantially parallel to the vertical support 90 or—as shown in FIG. 7*a*—somewhat obliquely to this alignment. In this alignment, a formwork element 98 can be taken up easily and raised by a fitter such that the beam 2 is ultimately located above a head 28 of the vertical support 90. Starting from this raised position, the formwork element 98 is then aligned and lowered by the fitter such that the fixing elements 52, 58 are introduced into the V-shaped cut-outs 14, 16 of the lug 10. This introduction is facilitated by the V shape of the cut-outs 14, 16. In this manner, a hook connection is therefore already established between the head 28 and the beam 2 in which the weight of the formwork element 98 can be led to a greater part via the support plane 32 into the vertical support 90 such that the person carrying out the assembly no longer has to hold the full weight of the formwork element 98.

Starting from the hook connection in accordance with FIG. 7*a*, the formwork element 98 in accordance with FIG. 7*b* is now pivoted upwardly in the arrow direction around a pivot axis extending parallel to the longitudinal axis of the beam 2, with the fixing elements 52, 58—guided by the V-shaped cut-outs 14, 16—automatically being moved into the recesses 22, 24 of the support surface 6 of the beam 2 during this pivot movement. The named pivot movement is continued for so long until the position in accordance with FIG. 7*c* is reached in which the formwork element 98 and its longitudinal beam 92 extend perpendicular to the vertical support 90 in the horizontal direction. It can be seen in a particularly illustrative manner from FIG. 7*c* that the abutment surfaces 80, 82 in this fully installed position effectively prevent the beam 2 from moving in the direction of the arrow perpendicular to the base section 4 of the beam 2 such that the fixing elements 52, 58 move out of engagement with the recesses 22, 24.

If, within the framework of the dismantling of the formwork element 98, work is carried out in the reverse order, the slope which is formed at the lower side of the support surface 6 and which includes an angle of approximately 75° with the base section 4 advantageously comes into effect. It namely becomes possible on the basis of this slope to pivot the formwork element 98 away, starting from the position in accordance with FIG. 7*c*, against the arrow direction of FIG. 7*b*, without a clamping effect occurring between the upper side of the formwork element 98, plywood lying thereon and an already prepared concrete slab. The slope rather ensures that all parts of the formwork element 98 move downwardly on the pivoting away such that a problem-free removal from the formwork becomes possible.

Figure 8A:
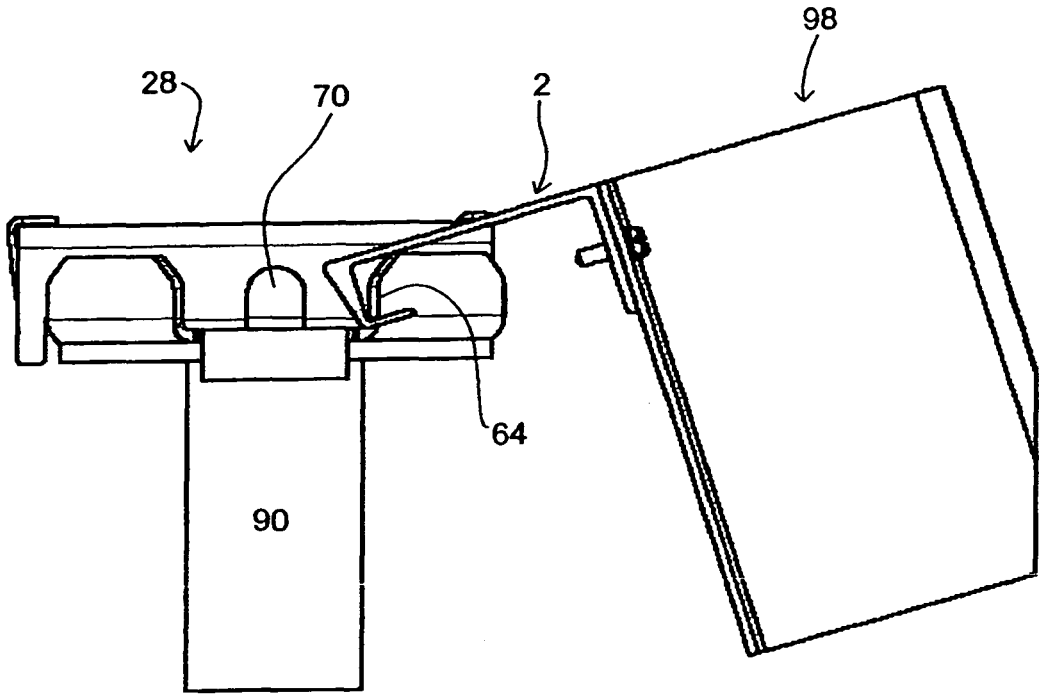
FIGS. 8*a-c* are views in accordance with FIGS. 7*a-c* with a head of a vertical support rotated by 90°.
Figure 8B:
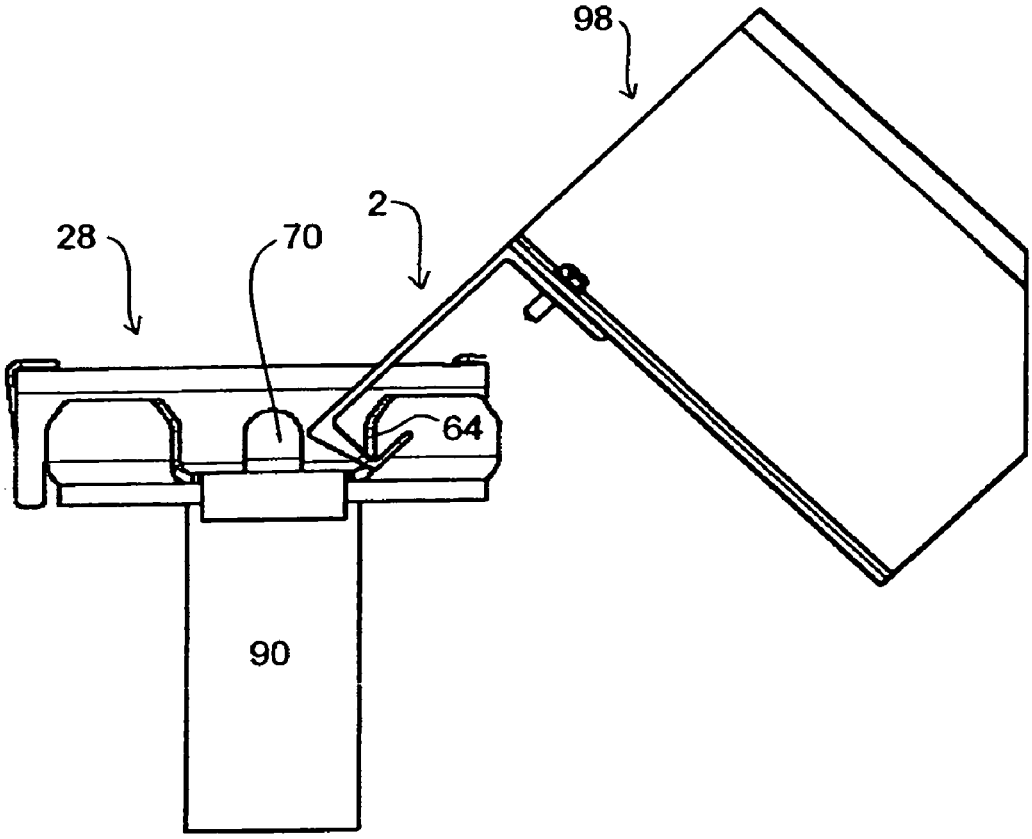
Figure 8C:
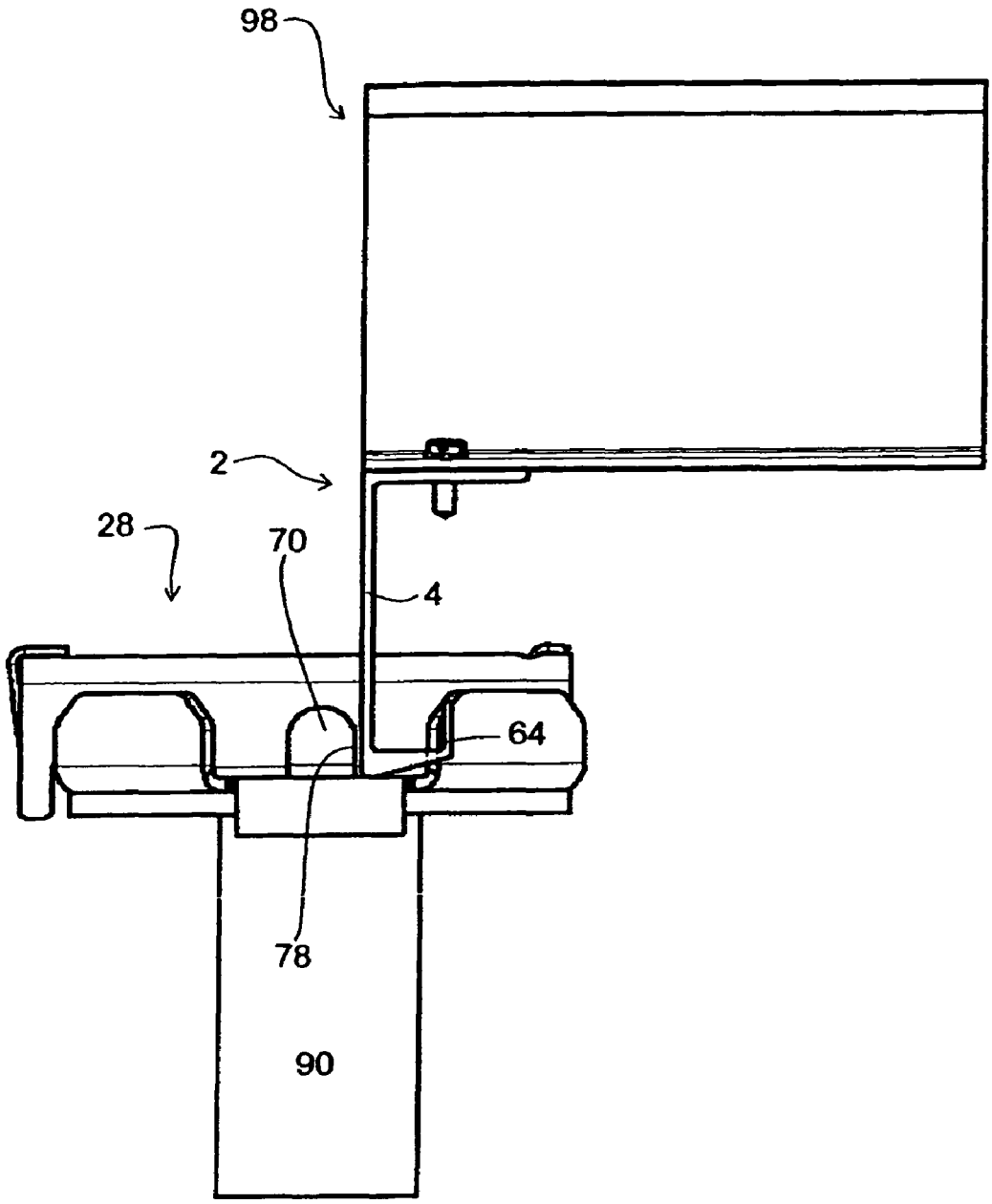

FIGS. 8*a-c* illustrate that a corresponding coupling process can be realized when it is ultimately desired for the fully installed formwork element 98 to extend in an angle relative to the head 28 offset by 90° with respect to FIGS. 5 and 7*a-c*. In this case, the fixing element 64 then, for example, cooperates with one of the cut-outs 12 or 14 or one of the recesses 20, 22 of the beam 2. The pivot process described runs in accordance with FIGS. 8*a* to 8*c* analogous to the pivot process described in connection with FIGS. 7*a* to 7*c* with the difference that the rear side of the base section 4 of the beam 2 in accordance with FIG. 8*c* is ultimately supported on the support surface 78 of the abutment lug 70, whereby it is in turn avoided that the fixing element 64 can move out of the recess 20 or 22.

Figure 9:
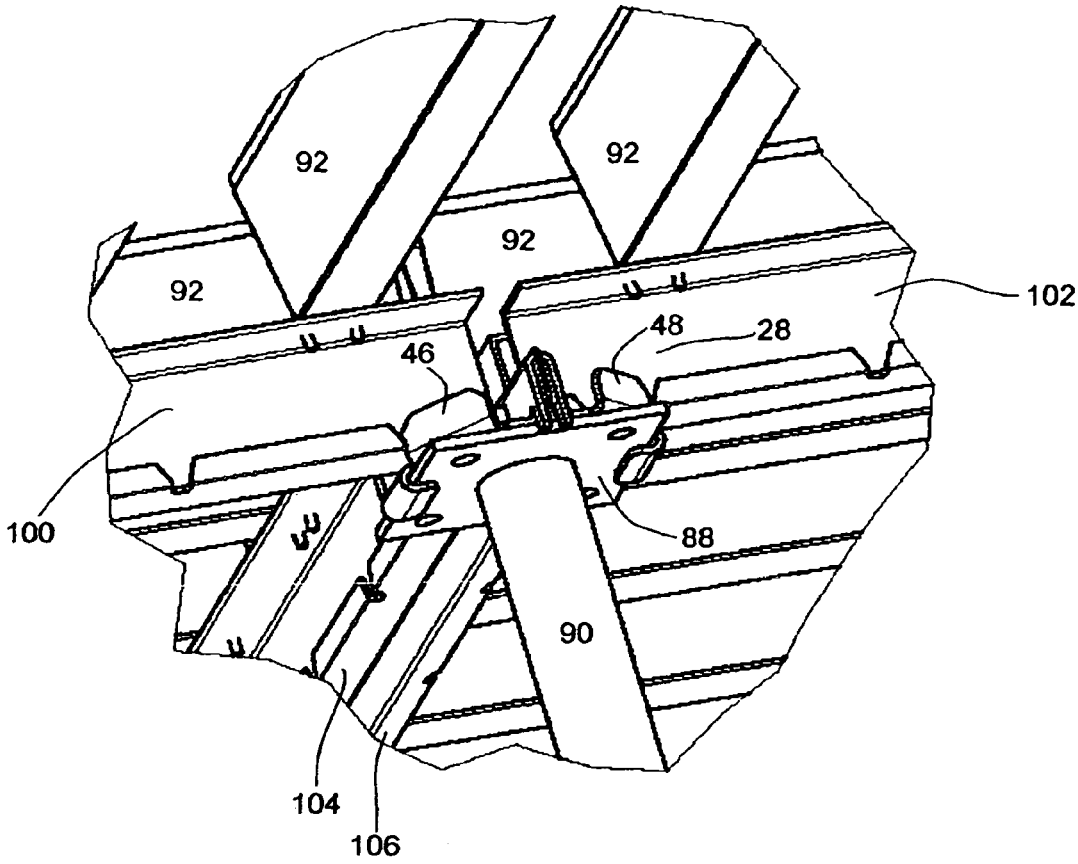
FIG. 9 is a three-dimensional view obliquely from below of a vertical support head coupled with four beams, with two beams being aligned perpendicular to two further beams.

FIG. 9 shows a total of four beams 100, 102, 104, 106 which are coupled to a head 28 of a vertical support 90. The two beams 100, 102 are arranged aligned with one another spaced apart from one another at the end face, whereas the two beams 104, 106 extend parallel to one another and perpendicular to the beams 100, 102. All beams 100 to 106 are made in the manner described in connection with the beam 2 in accordance with FIG. 1. The following fixing elements, cut-outs and abutment surfaces cooperate here with respect to the different beams 100 to 106:

beam 100: fixing element 56, recess 22, abutment surface 74 beam 102: fixing element 62, recess 22, abutment surface 76 beam 104: fixing element 52, recess 22, abutment surface 80 beam 106: fixing element 66, recess 22, abutment surface 86

Figure 10:
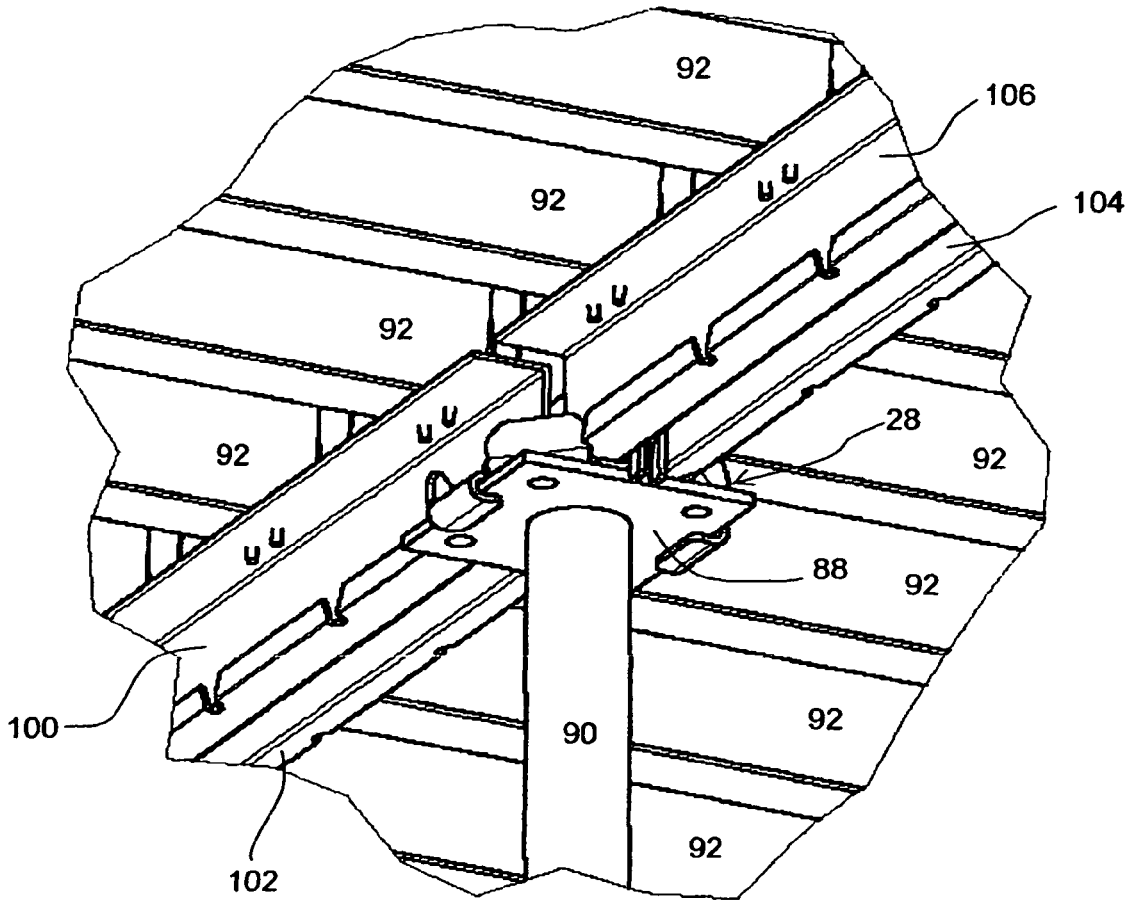
FIG. 10 is a view in accordance with FIG. 9 in which all four beams extend parallel to one another.

FIG. 10 shows an arrangement in which all the beams 100 to 106 extend parallel to one another, with in each case two beams 100 and 106 or 102 and 104 respectively being arranged aligned with one another in the longitudinal direction spaced apart from one another at the end face. In this arrangement, the following fixing elements, recesses and abutment surfaces cooperate:

beam 100: fixing element 52, recess 22, abutment surface 80 beam 102: fixing element 66, recess 22, abutment surface 86 beam 104: fixing element 58, recess 22, abutment surface 82 beam 106: fixing element 60, recess 22, abutment surface 84

In accordance with the invention, any other desired arrangements of one to four beams can also be realized at one head 28. In each beam 2 coupled with a head 28 via one of the two outer recesses 20 or 22, two different alignments of the beam 2 offset to one another by 90° can be realized completely independently of all other beams 2 coupled to the head 28.

The invention claimed is:

1. A slab formwork system comprising a plurality of formwork elements which have beams at their lower side which can be coupled to heads of vertical supports, the cross-section of said beams being made in C shape at least regionally with two limbs extending away from a base section, with one of the limbs being designed as a support surface for placement on a head of a vertical support, wherein the head of a vertical support has fixing elements engaging in each case into a recess of a support surface, with the recess being provided for the selective coupling of the beam to the vertical support in two directions offset by 90° with respect to one another at the end of the support surface remote from the base section, and wherein the vertical support and the beam of a formwork element can be hooked to one another in such a position in which the formwork element and the vertical support include an angle smaller than 90°, with a pivoting of the formwork element into such a position being made possible after the hooking together while maintaining the hook connection in which the formwork element and the vertical supports include an angle of approximately 90°.

2. A slab formwork system in accordance with claim 1, wherein the beam is made as an open section.

3. A slab formwork system in accordance with claim 1, wherein the support surface of the beam has two or more respective recesses in each of the two mutually remote end regions of the beam.

4. A slab formwork system in accordance with claim 3, wherein at least two recesses of the support surface and two fixing elements of the head of a vertical support are spaced apart from one another such that a simultaneous engagement of each of the two fixing elements into a respective one of the two recesses is made possible.

5. A slab formwork system in accordance with claim 1, wherein the support surface has at its end region remote from the base section an upwardly extending or angled lug, preferably extending parallel to the base section, which is provided with a cut-out in particular of V shape which is aligned with the recess provided in the support surface such that the cut-out and the recess merge into one another.

6. A slab formwork system in accordance with claim 5, wherein the lug has two or more respective cut-outs in each of the two mutually remote end regions of a beam, each of said cut-outs being aligned with corresponding recesses in the support surface.

7. A slab formwork system in accordance with claim 1, wherein the lower side of the support surface extends in its installed position, starting from the base section, obliquely upwardly so that in particular the angle between the lower side of the support surface and the base section is smaller than 90° and preferably amounts to between 70° and 80°.

8. A slab formwork system in accordance with claim 1, wherein the vertical supports are each provided with a support head which, in addition to a support plane extending perpendicular to the longitudinal extent of the respective vertical support, has fixing lugs angled therefrom for engagement into at least one recess of the support surface of a beam.

9. A slab formwork system in accordance with claim 8, wherein four fixing lugs are provided per support head which in particular extend perpendicular to the support plane of the support head.

10. A slab formwork system in accordance with claim 8, wherein adjacent fixing lugs of a support head extend perpendicular to one another.

11. A slab formwork system in accordance with claim 8, wherein the support plane has a substantially square shape, with its fixing lugs each extending parallel to diagonals of the support plane.

12. A slab formwork system in accordance with claim 1, wherein the support head has abutment regions for the rear side of the base section of a beam remote from the limbs, with the abutment surfaces of the abutment regions in particular extending perpendicular to the support plane.

13. A slab formwork system in accordance with claim 12, wherein a total of eight abutment regions are provided whose abutment surfaces in particular extend at an angle of 45° to the fixing lugs.

14. A slab formwork system in accordance with claim 12, wherein four abutment regions are formed by a section of the support head bent in U shape.

15. A slab formwork system in accordance with claim 12, wherein two respective abutment regions are formed by one respective abutment lug bent out of the support plane.

16. A slab formwork system in accordance with claim 1, wherein the support head is connected releasably or fixedly to the vertical support.

17. A slab formwork system in accordance with claim 1, wherein the support head can be coupled to a preferably substantially square head plate of a commercial vertical support.

18. A slab formwork system in accordance with claim 17, wherein the support head can be pushed onto the head plate in a direction extending parallel to the head plate of the vertical support.

19. A slab formwork system in accordance with claim 17, wherein the lower side of a support plane of the support head lies directly on the head plate of the vertical support in the installed position.

20. A slab formwork system in accordance with claim 1, wherein the support head is produced from one single bent, cast and/or forged steel plate or plastic plate, and is adapted to be fixed to a vertical support by means of a spring member held in the support head.

21. A slab formwork system in accordance with claim 1, wherein the formwork elements each consist of longitudinal beams extending spaced apart parallel to one another which are fixedly connected to at least one cross beam extending perpendicular thereto, with the upper sides of the longitudinal beams forming a contact surface for plywood, the upper side of the cross beam or beams contacting the lower side of the longitudinal beams and the lower side of the cross beam or beams forming said support surface.

22. A slab formwork system in accordance with claim 1, wherein the formwork elements have beams whose upper sides form a contact surface for plywood.

23. A slab formwork system in accordance with claim 1, wherein the formwork elements only have one or two beams, which are in particular straight, with them extending parallel to one another when two beams are provided.

24. A slab formwork system in accordance with claim 1, wherein the beam of a formwork element can be hooked to the vertical supports in such a position in which the formwork element extends substantially parallel to the vertical supports.

* * * * *